United States Patent [19]

Alonso

[11] Patent Number: 5,003,645

[45] Date of Patent: Apr. 2, 1991

[54] BIDET ASSEMBLY WITH DRAINAGE

[76] Inventor: Nelson Alonso, 1701 SW. 32 Ct., Miami, Fla. 33145

[21] Appl. No.: 476,201

[22] Filed: Feb. 7, 1990

Related U.S. Application Data

[63] Continuation-in-part of Ser. No. 279,741, Dec. 5, 1988.

[51] Int. Cl.[5] ..... A47K 3/22; E03D 9/08

[52] U.S. Cl. ..... 4/448; 4/420.4

[58] Field of Search ..... 4/443–448, 4/420.1–420.5

[56] References Cited

U.S. PATENT DOCUMENTS

| | | | |
|---|---|---|---|
| 1,752,782 | 4/1930 | Burton | 4/448 |
| 1,949,415 | 3/1934 | Guidetti et al. | 4/447 |
| 3,810,260 | 5/1974 | Lodi | 4/420.4 |
| 3,914,804 | 10/1975 | Schrader et al. | 4/420.4 X |
| 4,136,407 | 1/1979 | Maurer | 4/448 |
| 4,327,451 | 5/1982 | Baus | 4/420.2 |
| 4,559,964 | 12/1985 | Yamaguchi et al. | 4/448 X |
| 4,564,961 | 1/1986 | Kaneko et al. | 4/443 |

FOREIGN PATENT DOCUMENTS

| | | | |
|---|---|---|---|
| 2408334 | 7/1979 | France | 4/443 |
| 8102319 | 8/1981 | PCT Int'l Appl. | 4/420.4 |

*Primary Examiner*—Henry J. Recla
*Assistant Examiner*—Casey Jacyna
*Attorney, Agent, or Firm*—J. Sanchelima

[57] ABSTRACT

A bidet accessory includes a support assembly removably mounted to the rear flange member of conventional toilets. A valve assembly with a mixer provides temperature regulated water, through a conduit housed within the support assembly, to a sprayer that is removably suspended from a holder that includes collector for the residual water that drips from the sprayer. This residual water is channeled through a drainage channel to the bowl of the toilet. The mixer includes a threaded plug, spacer and hose connector members that are housed within a through opening in the support assembly. This construction permits the ready mounting of the conduit to the mixer's hose connector.

4 Claims, 3 Drawing Sheets

BIDET ASSEMBLY WITH DRAINAGE

OTHER RELATED APPLICATIONS

The present application is a continuation-in-part of allowed and pending U.S. patent application Ser. No. 07/279,741, filed on Dec. 5, 1988, which is hereby incorporated by reference.

BACKGROUND OF THE INVENTION

1. Field of the Invention

The present invention relates to accessories for toilets, and more particularly, to a removable bidet accessory.

2. Description of the Related Art

The parent application has provided a new bidet accessory for two-piece conventional toilets. However, the use of a sprayer member inherently created leaks after its use and, not infrequently, the leaking water found its way to the floor and rugs typically used in bathrooms. The different conduits and assemblies are within the user's sight making it aesthetically unappealing.

SUMMARY OF THE INVENTION

It is one of the main objects of the present invention to provide a volumetrically efficient bidet accessory for two-piece toilets that includes a holder for the sprayer member, an internal drainage channel and a spout for pouring the remaining water in a sprayer into the bowl of the toilet.

It is another object of this present invention to provide a bidet accessory that is aesthetically appealing and easy to clean by keeping all conduits within its supporting assembly.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
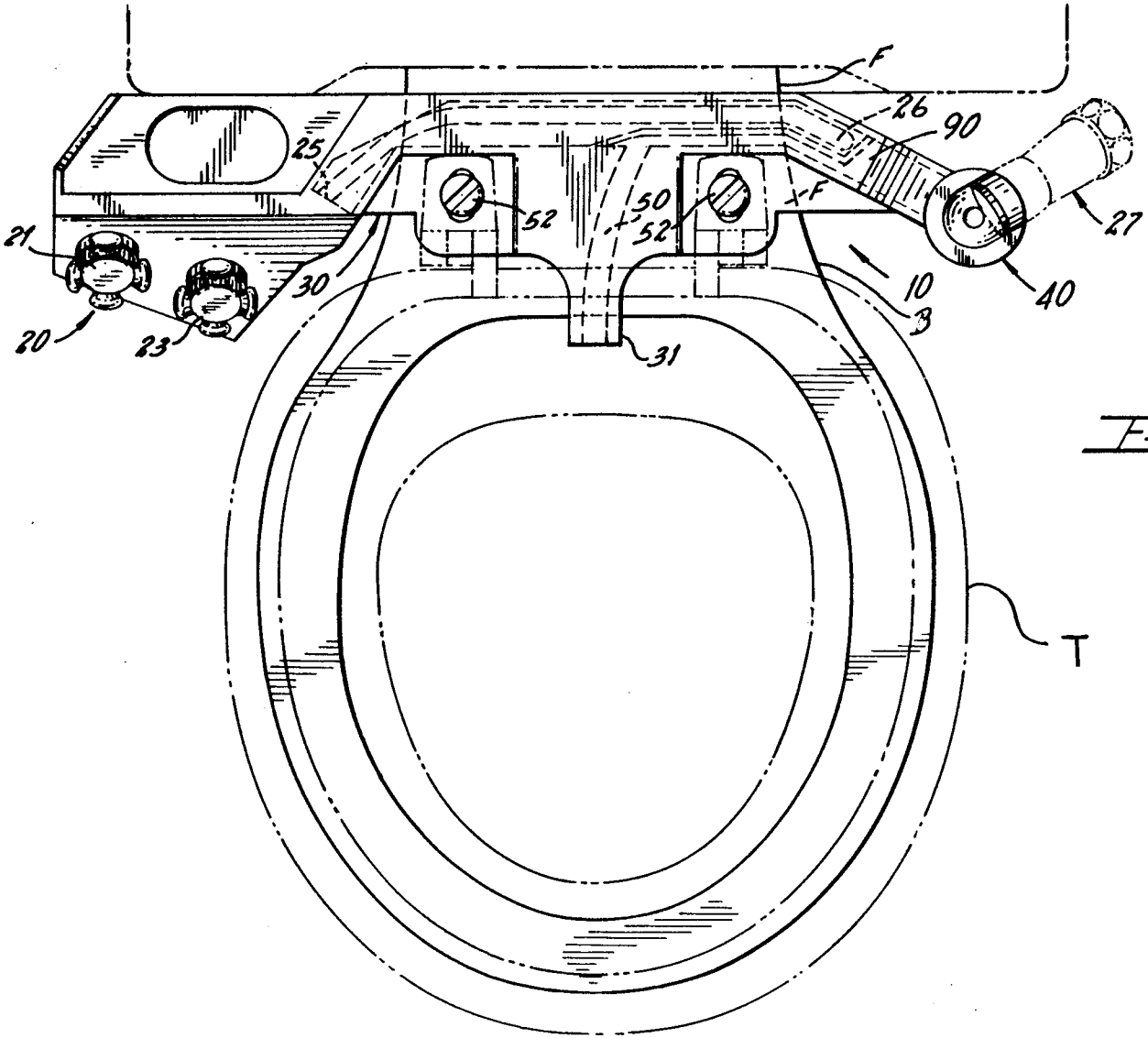
FIG. 1 represents a top view of an embodiment in accordance with the present invention installed between the tank and the toilet bowl.

Referring now to FIG. 1, where the present invention is generally referred to with numeral 10, it can be observed that it basically includes a valve assembly 20 mounted on supporting assembly 30 and sprayer member 27 removably held in position ready to use by holder assembly 40. A internal drainage channel 50 is connected to the lower end of holder assembly 40 and it is designed to carry any leaking water from sprayer member 27 to be discharged inside bowl B. Supporting assembly 30 is rigidly mounted to the rear portion of toilet bowl B through bolt and nut assemblies 52.

Supporting assembly 30 is preferably molded in plastic and has a substantially elongated shape. Assembly 30 is mounted through bolt and nut assembly 52 to the rear flange F of a conventional two-piece toilet T having a bowl B, as shown in FIG. 1. In the middle of the front of assembly 30, spout 31 extends to the front. The water that remains in sprayer member 27, after it has been used, falls inside bowl B. This residual water from sprayer member 27 is collected inside holder 40 and if flows down drainage channel 90 to spout member 31. Holder 40 has substantially a conical shape and it is connected at its bottom to drainage channel 90.

Figure 2:
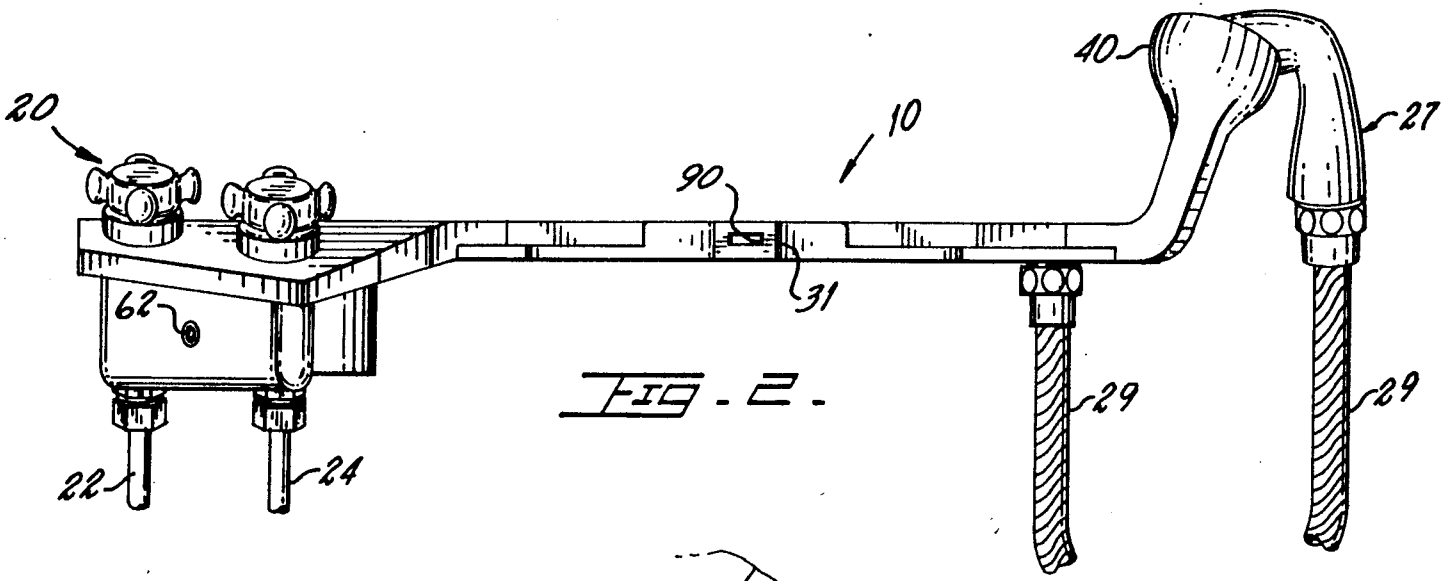
FIG. 2 shows a front end view of the bidet accessory represented in FIG. 1.

Valve assembly 20 includes hot and cold water inlets for supplies 22 and 24 that are mixed depending on the regulation of valve members 21 and 23 providing temperature regulated water through outlets 25 and 25' at the desired temperature, as best seen in FIG. 2. Flexible conduit member 26 is connected to common (or mixed) outlet 25" at one end and the other end is connected to hose 29 of sprayer member 27. An internal cavity 80 is provided to house hose member 26 therein out of the user's view.

Figure 4:
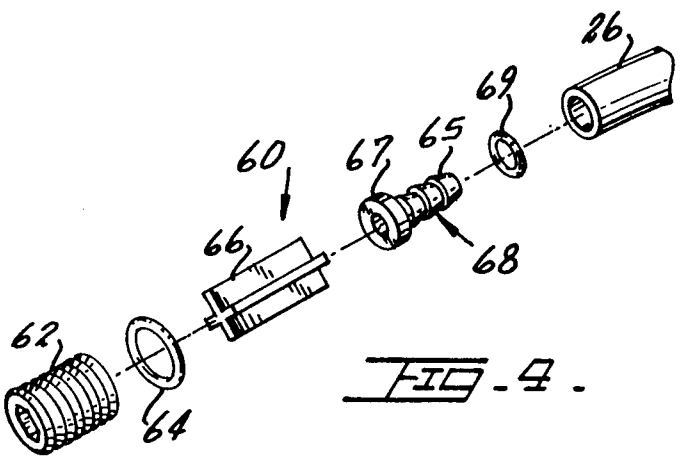
FIG. 4 is a representation of the water mixer mechanism used in the present invention.
Figure 3:
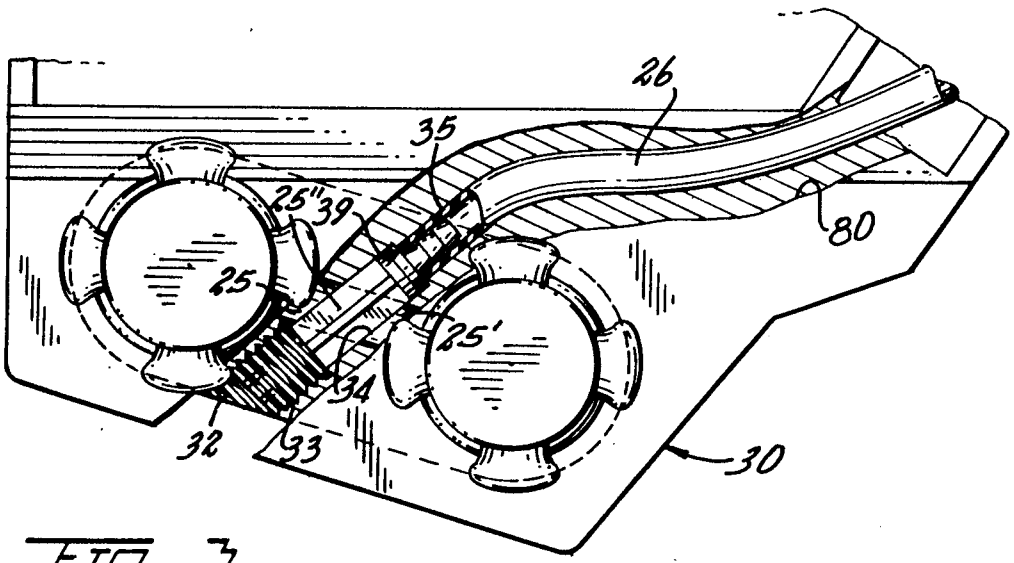
FIG. 3 illustrates a partial cross-sectional view of the valve assembly mechanism and channel for the water conduit.
Figure 5:
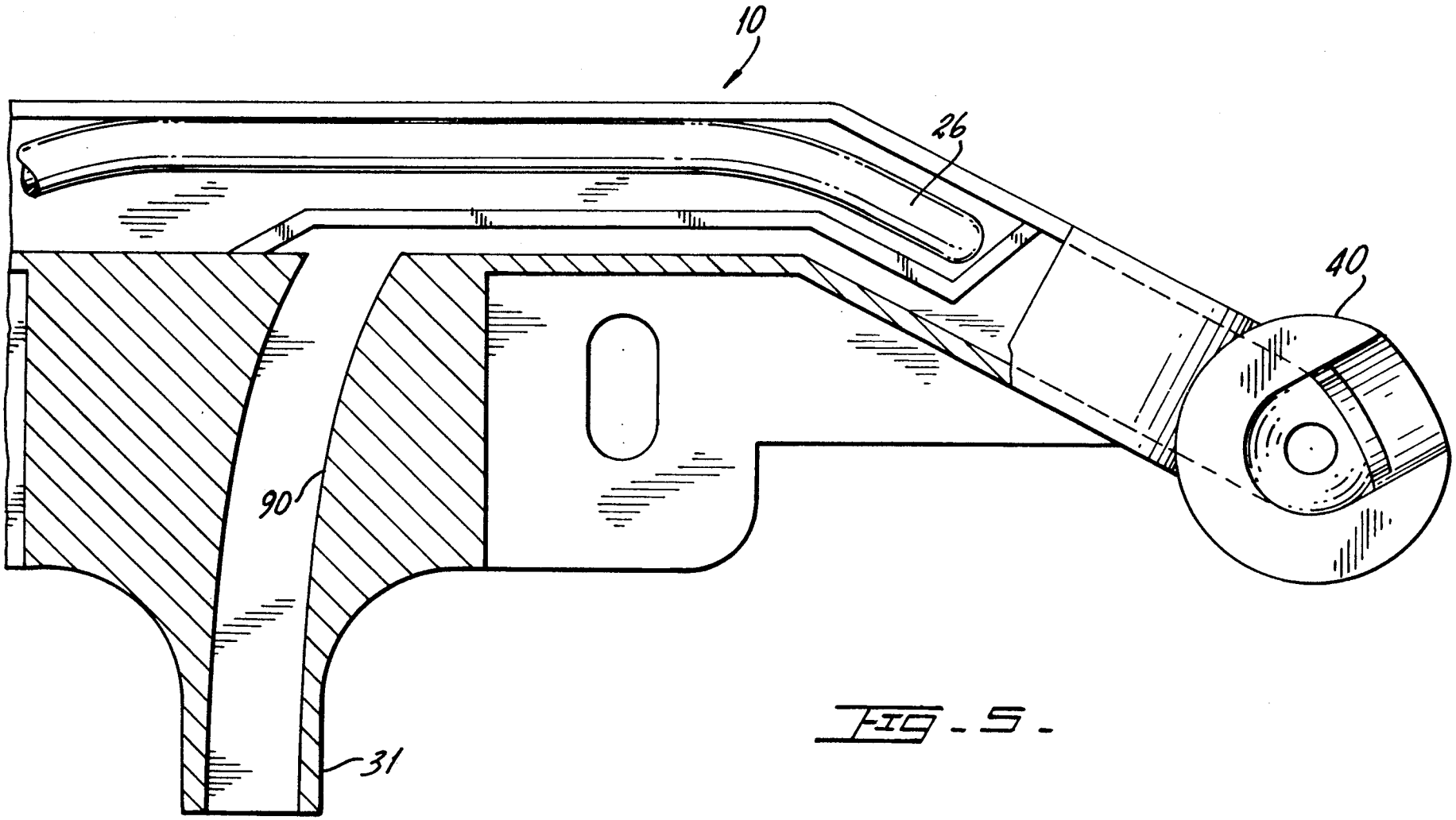
FIG. 5 is a detailed enlarged partial cross-sectional view of the support assembly section that includes the drainage channel.

A mixer valve assembly 60 is shown in FIGS. 3 and 4 consisting of threaded plug member 62, O-ring 64, spacer member 66, hose connector 68 and O-ring 69. Hose connector 68 implements outlet 25 in the preferred embodiment. Threaded plug member 62 is cooperatively received by threaded opening 32 and it includes, in the preferred embodiment, an allen set screw cavity for driving it inside through opening 32 from its counterbored threaded end section 33. This engagement is water tight. Through opening 32 has a counterbored end section 33, a middle section 34 having a smaller diameter and an internal end section 35 with an even smaller diameter. With this mixer assembly it is possible to avoid using the expensive connector fitting that otherwise needs to be mounted to opening 32. Also, it is easier and less expensive to assemble valve assembly 60 and hose member 26 within supporting assembly 30 by simply inserting member 26 through internal end section 35 and pulling it out through the other end (opening 32). Then member 26 is engaged with connector 68. Hose connector 68 includes an end 65 with several contiguous conical outside surface for a better grip to the internal wall of the hose to which it is connected and the other end having a head 67 with a diameter that snuggly fits within middle section 34. O-ring 69 also snuggly fits inside middle section 34 and its sandwiched between head 67 and step 39 of opening 32. End 65 protrudes inside section 35 which also houses the end of conduit 26 engaged to it.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A bidet accessory for installation in two-piece toilets having a flanged section in the rear and a bowl, and connected to hot and cold water supplies, comprising:

A. supporting means for holding bidet accessory in place having a substantially elongated shape and mounted to said rear flange and including an internal drainage channel, having two ends, within said supporting means and said drainage channel terminates on one end with a spout that extends over and inside said bowl;

B. valve means connected to said hot and cold water supplies for regulating the temperature of the water and including outlets through which said hot and cold water flows to a common outlet and said valve means being mounted to said supporting means and further including hot and cold water inlets connected to said hot and cold water supplies respectively;

C. flexible conduit means for routing the water having two ends and connected to said outlet at one of the ends;

D. sprayer means for directing the water connected at the other end of said conduit means wherein said sprayer means is hand held and is manually separable from said supporting means; and E. means for holding said sprayer means and being connected to said support means and to the other end of said drainage channel so that any water remaining in said sprayer means runs down from said sprayer means to said means for holding said sprayer flowing through said drainage channel and into said bowl.

2. The bidet accessory set forth in claim 1 wherein said supporting means further includes an internal cavity for housing said conduit means.

3. The bidet accessory set forth in claim 2 wherein said supporting means includes a through opening having a counterbored threaded end section, a middle section of smaller diameter and an internal section of even smaller diameter then said end and middle sections and said valve means further including mixer valve assembly means for mixing the hot and cold water having a hose connector engaged to said flexible conduit means at the outlet end and said hose connector being housed within said internal section and a spacer member housed within said middle section having an elongated shape that permits water to flow axially through said middle section, and a threaded plug member housed within said threaded end section in cooperative water tight engagement.

4. The bidet accessory set forth in claim 3 wherein said mixer valve assembly means further includes first means for sealing mounted between said plug and spacer members and second means for sealing mounted between said space and hose connector members.

* * * * *